US012808205B2

(12) United States Patent
Fu

(10) Patent No.: US 12,808,205 B2
(45) Date of Patent: Nov. 24, 2026

(54) FLOORING COMPONENT AND FLOORING

(71) Applicant: Changzhou Zero Point Wood Industry Co., Ltd., Changzhou City (CN)

(72) Inventor: Chunhua Fu, Changzhou City (CN)

(73) Assignee: Changzhou Zero Point Wood Industry Co., Ltd.

( * ) Notice: Subject to any disclaimer, the term of this patent is extended or adjusted under 35 U.S.C. 154(b) by 84 days.

(21) Appl. No.: 19/059,340

(22) Filed: Feb. 21, 2025

(65) Prior Publication Data

US 2026/0185362 A1 Jul. 2, 2026

(30) Foreign Application Priority Data

Dec. 26, 2024 (CN) ..... 202411948195.2

(51) Int. Cl.
*E04F 15/02* (2006.01)

(52) U.S. Cl.
CPC ..... *E04F 15/02038* (2013.01); *E04F 2201/0153* (2013.01); *E04F 2201/042* (2013.01); *E04F 2201/091* (2013.01)

(58) Field of Classification Search
CPC ..... E04F 15/02038; E04F 2201/0153; E04F 2201/042; E04F 2201/091
See application file for complete search history.

(56) References Cited

U.S. PATENT DOCUMENTS 8,820,014 B2 * 9/2014 Durnberger ..... E04F 15/02038 52/309.3
9,567,755 B2 * 2/2017 Ramachandra ..... E04F 15/206
9,822,533 B2 * 11/2017 Huang ..... E04B 5/02
9,856,658 B2 * 1/2018 Yang ..... E04F 15/02038
10,538,922 B2 * 1/2020 Pervan ..... E04F 15/02038
10,689,862 B2 * 6/2020 Liu ..... B29C 63/0017
11,982,085 B2 * 5/2024 Boo ..... E04C 2/00
12,325,994 B2 * 6/2025 Boo ..... E04C 2/00
2011/0030300 A1 * 2/2011 Liu ..... E04F 15/02 52/745.05

(Continued)

FOREIGN PATENT DOCUMENTS

JP H06320510 A 11/1994

OTHER PUBLICATIONS

European Search Report issued in corresponding European Patent Application No. 25158403 dated Jul. 25, 2025, pp. 1-8.

*Primary Examiner* — Rodney Mintz

(74) *Attorney, Agent, or Firm* — Nathan & Associates; Menachem Nathan

(57) ABSTRACT

The application discloses a flooring component and a flooring. During the process of connecting the second component with the first component, the second protrusion in the edge structure of the second component can squeeze the first protrusion, and the squeezing force is transmitted to the first elastic layer through the first protrusion, causing the first elastic layer to produce elastic deformation, thereby changing the position of the first protrusion, making the opening of the second groove larger, thereby enabling the second protrusion to be smoothly received in the second groove, and the third protrusion to be smoothly received in the first groove, which effectively reduces the installation difficulty between the first component and the second component.

20 Claims, 8 Drawing Sheets

(56) References Cited

U.S. PATENT DOCUMENTS

| | | | | |
|---|---|---|---|---|
| 2013/0036695 | A1 | 2/2013 | Durnberger | |
| 2016/0177578 | A1* | 6/2016 | Ramachandra | E04F 15/102 52/588.1 |
| 2016/0273230 | A1* | 9/2016 | Yang | E04F 15/02038 |
| 2017/0073977 | A1* | 3/2017 | Huang | E04F 15/02194 |
| 2018/0002933 | A1* | 1/2018 | Pervan | E04F 15/102 |
| 2019/0106888 | A1* | 4/2019 | Liu | B32B 37/0053 |
| 2022/0127850 | A1* | 4/2022 | Boo | E04C 2/00 |
| 2024/0360670 | A1* | 10/2024 | Boo | E04C 2/00 |
| 2025/0270812 | A1* | 8/2025 | Boo | E04C 2/00 |
| 2026/0168256 | A1* | 6/2026 | Fu | E04F 15/02038 |

* cited by examiner

FLOORING COMPONENT AND FLOORING

CROSS-REFERENCE TO RELATED APPLICATION

This application claims priority to and the benefit of Chinese Patent Application No. 202411948195.2, filed on Dec. 26, 2024, the disclosures of which is incorporated herein by reference in its entirety.

TECHNICAL FIELD

The present application is related to the technical field of decorative materials, and in particular to a flooring component and a flooring.

BACKGROUND

In indoor and outdoor decoration, it is often required to cover the ground, walls and other surfaces. For example, flooring is a material used to cover the ground, and there are many types, including solid wood flooring, laminate flooring, bamboo flooring, cork flooring, tile flooring and plastic flooring. At present, floorings are connected by mortise-and-tenon joint, that is, the connection is achieved by using the male tenon of a plate and the female mortise of another plate to engage with each other. In order to make the male tenon smoothly fit into the female groove, the cutting surface for the engagement process needs to be made relatively smooth, which will cause the male tenon to easily fall out of the female groove, affecting the connection stability of the floorings.

SUMMARY

An objective of the present application is to provide a flooring component to solve the technical problem of insufficient connection stability between flooring panels. A further objective of the present application is to provide a flooring.

In a first aspect, an embodiment of the present application provides a flooring component, including a first component and a second component, wherein the second component is configured to be connectable to at least one side of the first component;

wherein the first component includes a first plate, a first protrusion and a first elastic layer, wherein a first groove facing toward the second component is defined on the first plate, the first protrusion is arranged on a side of the first plate closer to the second component and is spaced apart from the first plate, the first elastic layer is arranged below the first protrusion and is connected to the first plate and the first protrusion, and the first plate, the first protrusion and the first elastic layer define a second groove with an opening facing upward so that the second groove is surrounded by the first plate, the first elastic layer and the first protrusion;

where the second component is provided with an edge structure including a second protrusion protruding downward and a third protrusion protruding toward the first component, wherein the second protrusion is configured to be able to squeeze the first protrusion so that the first protrusion forces the first elastic layer to produce elastic deformation that enables the second protrusion to be received in the second groove and enables the third protrusion to be received in the first groove.

In some embodiments, the first protrusion is movable between a first position and a second position, wherein the opening of the second groove has a first size when the first protrusion is in the first position, and the opening of the second groove has a second size when the first protrusion is in the second position, and wherein the first size is smaller than the second size;

when the second protrusion presses the first protrusion, the first protrusion moves from the first position to the second position to enable the second protrusion to be received in the second groove.

In some embodiments, when the first protrusion moves from the first position to the second position, the first protrusion presses the first elastic layer to cause a compression deformation thereof, so that a thickness of at least a portion of the first elastic layer is reduced.

In some embodiments, when the first protrusion moves from the first position to the second position, the first protrusion presses the first elastic layer to cause a bending deformation thereof, so that at least a portion of the first elastic layer is bent downward.

In some embodiments, when the second protrusion is received in the second groove, the first protrusion is in the first position.

In some embodiments, the first elastic layer is further arranged below the first plate, and a first bottom wall of the first plate and a second bottom wall of the first protrusion are both connected to a first upper surface of the first elastic layer.

In some embodiments, the first plate has a first side wall facing toward the second component, an opening of the first groove extends from the first side wall, and the first protrusion has a second side wall opposite to the first side wall;

wherein the first elastic layer is connected to the first side wall, a second bottom wall of the first protrusion is connected to a first upper surface of the first elastic layer, and the second groove is surrounded by the first upper surface, the first side wall, and the second side wall.

In some embodiments, the first plate further has a mounting groove facing toward the second component, the mounting groove is arranged below the first groove, the first elastic layer is received in the mounting groove and extends toward the second component so that at least a portion of the first elastic layer is located below the first protrusion.

In some embodiments, the second component further includes:

a second plate, wherein the edge structure is connected to a side of the second plate closer to the first component, and a third groove is formed between the second plate and the second protrusion;

when the second protrusion is received in the second groove, the first protrusion is received in the third groove.

In some embodiments, the third protrusion has a third side wall, the second plate has a fourth side wall opposite to the third side wall, the edge structure further includes a connecting surface connecting the third side wall to the fourth side wall, and the third groove is surrounded by the connecting surface, the third side wall and the fourth side wall.

In some embodiments, when the second protrusion is received in the second groove, the third side wall is in contact with a second side wall of the first protrusion, and an angle $\alpha$ is formed between the third side wall and a first upper surface of the first elastic layer, where $90° \leq \alpha \leq 100°$.

In some embodiments, the second component further includes:

a second elastic layer, arranged below the second plate and is connected to the second plate.

In some embodiments, materials of the first elastic layer and the second elastic layer are selected from one or more of rubber, thermoplastic elastomer, polyvinyl chloride elastomer, polyethylene copolymer, and thermoplastic polyurethane.

In some embodiments, the first component and the second component are same in structure, and the edge structure and the first protrusion are provided on each of the first component and the second component, wherein the edge structure and the first protrusion of each of the first component and the second component are arranged opposite to each other.

In some embodiments, the first component has a first side and a second side opposite to each other, and the first protrusion is arranged on each of the first side and the second side;

wherein the second component has a third side and a fourth side opposite to each other, and the edge structure is arranged on each of the third side and the fourth side.

In a second aspect, an embodiment of the present application provides a flooring, including the above flooring component.

The flooring component of the embodiments of the present application includes a first component and a second component, and the second component is configured to be connected to at least one side of the first component; the first component includes a first plate, a first protrusion and a first elastic layer, the first plate is provided with a first groove facing toward the second component, the first protrusion is arranged on a side of the first plate closer to the second component, and is spaced apart from the first plate, the first elastic layer is arranged below the first protrusion, and is connected to the first plate and the first protrusion; the first plate, the first elastic layer, and the first protrusion define a second groove with an opening facing upward so that the second groove is surrounded by the first plate, the first elastic layer, and the first protrusion; the second component is provided with an edge structure, the edge structure includes a second protrusion protruding downward and a third protrusion protruding toward the first component, the second protrusion is configured to be able to squeeze the first protrusion, so that the first protrusion forces the first elastic layer to produce elastic deformation, so that the second protrusion is received in the second groove, and the third protrusion is received in the first groove. In the embodiment of the present application, by arranging the first elastic layer below the first protrusion, and connecting the first plate and the first protrusion spaced apart from each other through the first elastic layer to form the second groove, in the process of connecting the second component to the first component, the second protrusion in the edge structure of the second component can squeeze the first protrusion, and the squeezing force is transmitted to the first elastic layer through the first protrusion, causing the first elastic layer to produce elastic deformation, thereby changing the position of the first protrusion, making the opening angle of the second groove larger, and then enabling the second protrusion smoothly to be received in the second groove, and the third protrusion smoothly to be received in the first groove, which effectively reduces the installation difficulty between the first component and the second component. In addition, since the first elastic layer can produce elastic deformation during the assembly process, changing the position of the first protrusion, so that the first component and the second component can be connected more smoothly, there is no need to reduce the height of the first protrusion in order to smoothly receive the second protrusion into the second groove, and thus the first protrusion can be made with a greater height, thereby improving the lateral connection strength of the first component and the second component, improving the connection stability of the two, and reducing the occurrence of the detaching of the first component and the second component from one another.

The floorings of the embodiments of the present application may include all the technical features and technical effects of the above-mentioned flooring components, which will not be repeated here.

BRIEF DESCRIPTION OF THE DRAWINGS

In order to more clearly illustrate the technical solutions in the embodiments of the present application, the drawings required for use in the description of the embodiments will be briefly introduced below. Obviously, the drawings described below are only some embodiments of the present application. For those skilled in the art, other drawings can be obtained based on these drawings without doing any creative work.

LIST OF REFERENCE NUMERALS

Figure 1:
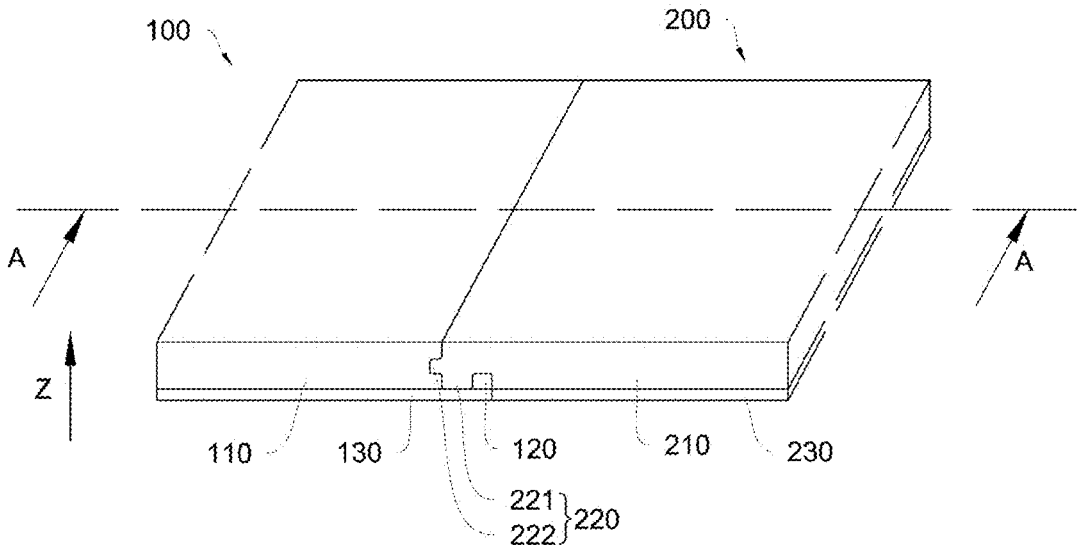
FIG. 1 is a schematic diagram of a partial structure of a flooring component according to an embodiment of the present application.

100, first component; 101, first side; 102, second side; 110, first plate; 111, first side wall; 112, first bottom wall; 120, first protrusion; 121, second side wall; 122, second bottom wall; 130, first elastic layer; 131, first upper surface; 140, first groove; 141, opening of first groove; 150, second groove; 151, opening of second groove; 160, mounting groove; 200, second component; 201, third side; 202, fourth side; 210, second plate; 211, fourth side wall; 212, third bottom wall; 220, edge structure; 221, second protrusion; 222, third protrusion; 223, third side wall; 224, connecting surface; 230, second elastic layer; 231, second upper surface; 240, third groove; Z, thickness direction.

DETAILED DESCRIPTION OF THE EMBODIMENTS

The technical solutions in the embodiments of the present application will be described clearly and completely below in conjunction with the drawings in the embodiments of the present application. Obviously, the described embodiments are only part of the embodiments of the present application, rather than all of the embodiments. Based on the embodiments in the present application, all other embodiments obtained by those skilled in the art without doing creative work are within the scope of protection of the present application.

In the description of the present application, it should be understood that the orientation or positional relationship indicated by the terms "upper", "lower", "top", "bottom", "inside", "outside", etc. is based on the orientation or positional relationship shown in the drawings, and is only for the convenience of describing the present application and simplifying the description, rather than indicating or implying that the device or apparatus referred to must have a specific orientation, be constructed and operated in a specific orientation, and therefore cannot be understood as a limitation on the present application. "A plurality of" means two or more, and at least one means one, two or more, unless otherwise clearly and specifically defined. The terms "installed", "connected", and "coupled" should be understood in a broad sense, for example, it can be a fixed connection, a detachable connection, or an integral connection; it can be directly connected or indirectly connected through an intermediate medium, it can be the internal connection of two devices or the interaction relationship between two devices, unless otherwise clearly and specifically defined. The terms "first" and "second" are used for descriptive purposes only, and cannot be understood as indicating or implying relative importance or implicitly indicating the number of technical features indicated. Therefore, the features defined as "first" and "second" can explicitly or implicitly include one or more of the features.

As an introduction to this application, floorings are connected mainly in a mortise-and-tenon joint, that is, the connection is achieved by engaging the male tenon of a plate with the female mortise of another plate. In order to smoothly insert the male tenon into the female mortise, the cutting surface for the engagement process of the two needs to be made relatively flat, that is, the stopper on the female mortise is made relatively low, which will cause the male tenon to easily fall out of the female mortise, affecting the connection stability of the floorings.

In view of this, an embodiment of the present application provides a flooring component, which is a part of a flooring. Specifically, it can be a combined structural unit for flooring. By laying a plurality of flooring components to achieve overall coverage, decoration and protection of the ground, the laying of the floor is completed. The groove of the flooring component is on an elastic layer, and thus the elastic deformation ability of the elastic layer contributes to reducing the difficulty of assembly and improving the stability of the connection. In addition, the elastic layer can also be used to improve the comfort level of the flooring for feet.

Referring to FIG. 1, the flooring component of an embodiment of the present application includes a first component 100 and a second component 200. The first component 100 and the second component 200 are structured as plates, which are used to be connected to each other to cover and decorate the ground. Specifically, the second component 200 is configured to be connectable to at least one side of the first component 100.

It should be noted that the flooring component has an unassembled state and an assembled state. The unassembled state is a state in which the flooring component is not installed on the ground. In the unassembled state, the first component 100 and the second component 200 are not assembled or connected to each other, and installation and laying are required to make the first component 100 and the second component 200 combined with each other. The assembled state is a state in which the flooring component is installed on the ground. In the assembled state, the first component 100 and the second component 200 are assembled and connected to each other. It can be understood that the flooring component may be in the assembled state or the unassembled state. In order to facilitate the description of the structure and assembly of each member in the flooring component, the following mainly describes the assembled state.

Figure 2:
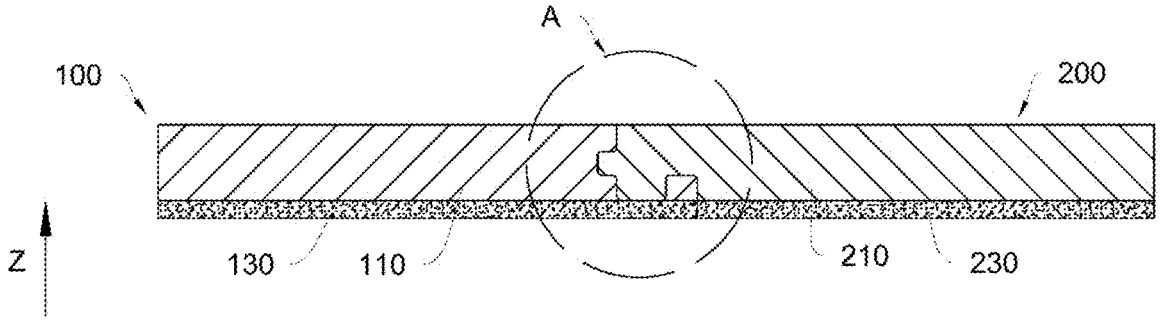
FIG. 2 is a cross-sectional view of the flooring component along line A-A in FIG. 1.
Figure 4:
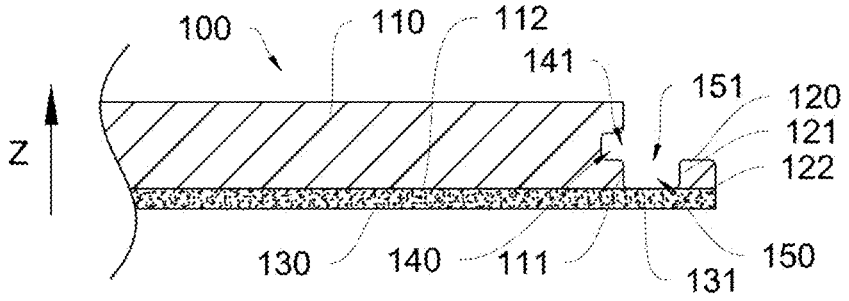
FIG. 4 is a part of a cross-sectional view of a first component in a flooring component according to an embodiment of the present application.

Please refer to FIGS. 2 and 4, the first component 100 includes a first plate 110, a first protrusion 120 and a first elastic layer 130. The first plate 110 defines a first groove 140 toward the second component 200, that is, the first groove 140 is defined at the edge of the first plate 110. The first protrusion 120 is arranged on the side of the first plate 110 closer to the second component 200, and is spaced apart from the first plate 110. The first elastic layer 130 is arranged below the first protrusion 120, and is respectively connected to the first plate 110 and the first protrusion 120. The first plate 110, the first elastic layer 130, and the first protrusion 120 define a second groove 150 with an opening 151 facing upward so that the first plate 110, the first elastic layer 130, and the first protrusion 120 surround the second groove 150. As shown in FIG. 4, the first protrusion 120 is arranged at the edge of the first component 100, and the first elastic layer 130 is located below the first protrusion 120, and is connected to the first protrusion 120 and the first plate 110. Thus, the first upper surface 131 of the first elastic layer 130 serves as the bottom wall of the second groove 150, and the first side wall 111 of the first plate 110 and the second side wall 121 of the first protrusion 120 respectively serve as the side walls of the second groove 150.

Figure 3:
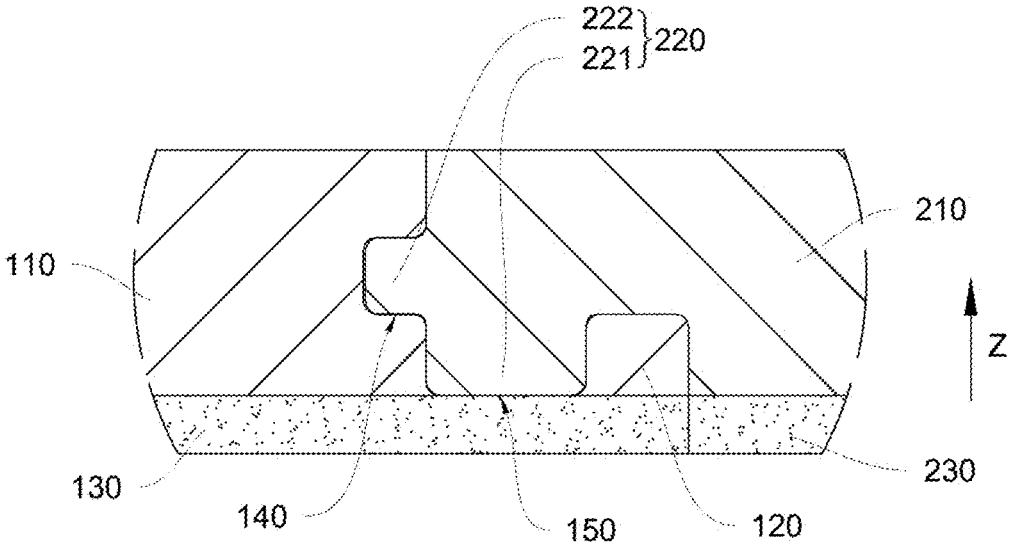
FIG. 3 is a schematic diagram of a partial enlarged structure of area A in FIG. 2.
Figure 5:
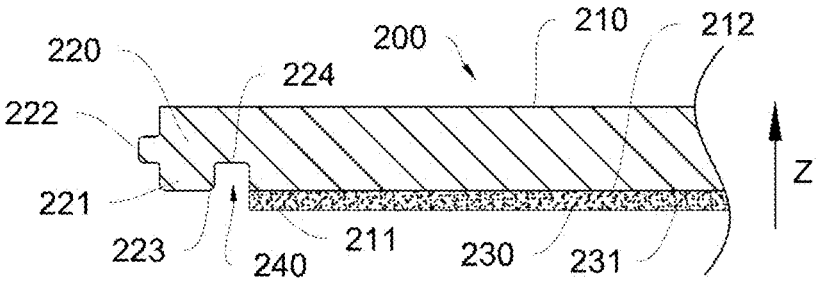
FIG. 5 is a part of a cross-sectional view of a second component in a flooring component according to an embodiment of the present application.

Please refer to FIGS. 2 and 5, the second component 200 is provided with an edge structure 220, and the edge structure 220 is located at the edge of the second component 200. The second component 200 is connected to the first component 100 by the edge structure 220. Specifically, the edge structure 220 includes a second protrusion 221 protruding downward and a third protrusion 222 protruding toward the first component 100. As shown in FIG. 3, when the first component 100 and the second component 200 are connected to each other, the second protrusion 221 is received in the second groove 150, and the third protrusion 222 is received in the first groove 140.

In an embodiment of the present application, by arranging the first elastic layer 130 below the first protrusion 120, during the process of connecting the second component 200 with the first component 100, the second protrusion 221 can squeeze the first protrusion 120, so that the first protrusion 120 transmits the squeezing force to the first elastic layer 130, and the first elastic layer 130 has an elastic deformation accordingly. Therefore, the first protrusion 120 can be displaced due to squeezing, changing the angle of the opening 151 of the second groove 150, so that the second protrusion 221 can be smoothly received in the second groove 150, and the third protrusion 222 can be smoothly received in the first groove 140.

Figure 6:
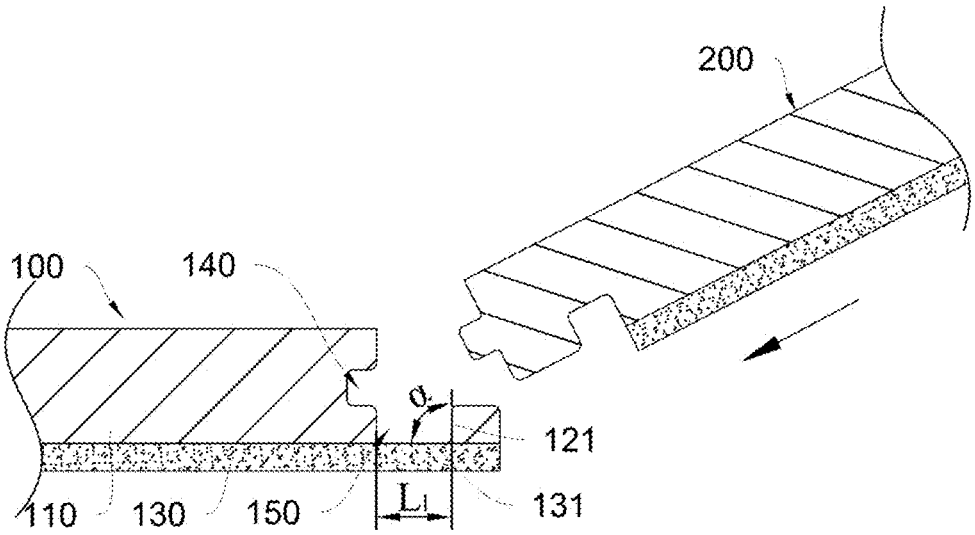
FIG. 6 is a schematic diagram of a first assembling state of a first component and a second component in a flooring component according to an embodiment of the present application.
Figure 7:
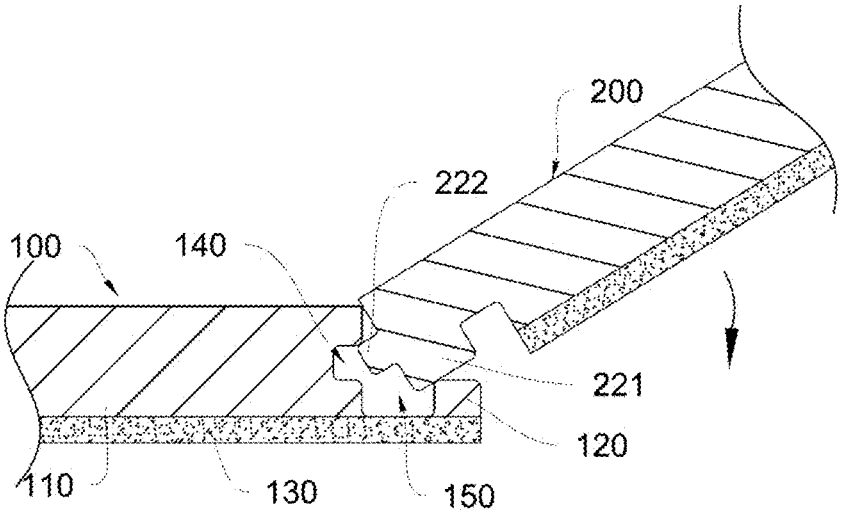
FIG. 7 is a schematic diagram of a second assembling state of a first component and a second component in a flooring component according to an embodiment of the present application.
Figure 8:
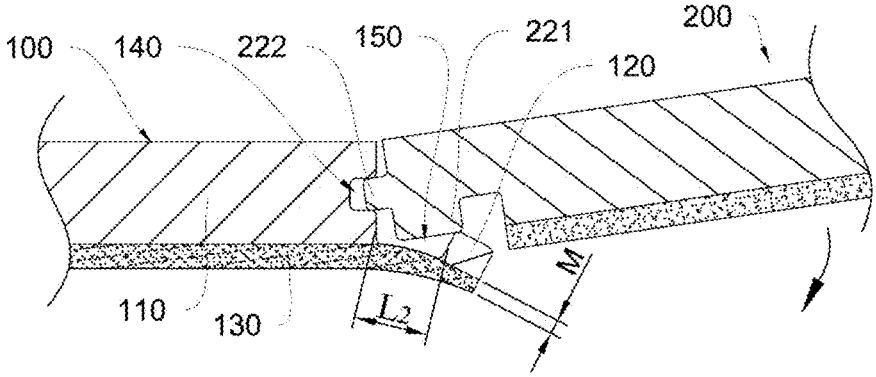
FIG. 8 is a schematic diagram of a third assembling state of a first component and a second component in a flooring component according to an embodiment of the present application.

Please refer to FIGS. 6 to 8, in some embodiments, the process of assembling the flooring component can be roughly divided into three states. As shown in FIG. 6, in the first assembling state, the first component 100 is laid on the ground, and the second component 200 is tilted closer to the first component 100, so that the third protrusion 222 moves toward the first groove 140. As shown in FIG. 7, in the second assembling state, a part of the third protrusion 222 comes into the first groove 140, and the second protrusion 221 presses on the inner top corner of the first protrusion 120. As shown in FIG. 8, in the third assembling state, the second component 200 is pressed downward obliquely, the second protrusion 221 presses down the first protrusion 120, and the first protrusion 120 transmits the pressure to the first elastic layer 130, so that the first elastic layer 130 has an elastic deformation and is compressed and/or bent downward, so that the first protrusion 120 can follow the deformation of the first elastic layer 130 and move outward and downward, and then the opening 151 of the second groove 150 is enlarged. As the first protrusion 120 moves outward and downward, the second protrusion 221 is gradually received into the second groove 150, and the third protrusion 222 is also gradually received into the first groove 140. As the downward pressure of the second protrusion 221 on the first protrusion 120 decreases or even disappears, the first elastic layer 130 is restored to its initial shape, so that the first protrusion 120 moves back to its initial position, and the connection and locking of the first component 100 and the second component 200 are achieved.

It can be understood that in the embodiment of the present application, by providing the first elastic layer 130, the difficulty of installation between the first component 100 and the second component 200 is effectively reduced. In addition, since the first elastic layer 130 produces elastic deformation during the assembling process, the position of the first protrusion 120 can be changed, so that the first component 100 and the second component 200 can be connected to each other more smoothly. Therefore, the first protrusion 120 can have a greater height, thereby improving the connection strength of the first component 100 and the second component 200 in a lateral direction, improving the connection stability of the two, and reducing the occurrence of the first component 100 and the second component 200 being separated. The lateral direction is the direction perpendicular to the thickness direction Z in FIG. 2.

Please refer to FIGS. 6 to 8 again, in some embodiments, the first protrusion 120 can move between a first position and a second position. It should be noted that the first position and the second position are two relative positions, not absolute positions in space. The first position is the position of the first protrusion 120 relative to the first plate 110 when it is not squeezed. The second position is the position of the first protrusion 120 relative to the first plate 110 when it is squeezed by the second protrusion 221 to move outward. The opening 151 of the second groove 150 has a first size in the first position, and the opening 151 of the second groove 150 has a second size in the second position, satisfying that the first size is smaller than the second size.

Optionally, the first size and the second size may refer to the angle of the opening 151 of the second groove 150, that is, the angle between the two side walls of the second groove 150 (the first side wall 111 and the second side wall 121). In the first position, the angle of the opening 151 of the second groove 150 is relatively small, while in the second position, the first protrusion 120 is squeezed by the second protrusion 221, so that the first elastic layer 130 is squeezed and deformed. As a result, the angle of the opening 151 of the second groove 150 becomes larger, and the second protrusion 221 can be more easily received in the second groove 150.

Optionally, as shown in FIGS. 6 and 8, the first size and the second size are both the width size of the opening 151 of the second groove 150. Specifically, in the first position, the first size is the width L1 of the opening 151 of the second groove 150, and in the second position, the second size is the width L2 of the opening 151 of the second groove 150, satisfying: $L1<L2$. In the second position, the first protrusion 120 is squeezed by the second protrusion 221, and the first elastic layer 130 is squeezed and deformed accordingly. Therefore, the first protrusion 120 moves outward and downward, resulting in an increase in the width of the opening 151 of the second groove 150, satisfying: $L1<L2$.

In the above embodiments, when the second protrusion 221 presses the first protrusion 120, the first protrusion 120 can move from the first position to the second position, so that the second protrusion 221 is received in the second groove 150.

Please refer to FIG. 8, in some embodiments, when the first protrusion 120 moves from the first position to the second position, the first protrusion 120 squeezes the first elastic layer 130 to cause it to bend, so that at least a portion of the first elastic layer 130 is bent downward. Thus, the first protrusion 120 can move down, so that its height relative to the ground is reduced, and the angle of the opening 151 of the second groove 150 is enlarged. In this way, the second protrusion 221 can be more smoothly received in the second groove 150.

In some embodiments, when the first protrusion 120 moves from the first position to the second position, the first protrusion 120 squeezes the first elastic layer 130 to cause compression deformation, so that the thickness M of at least part of the first elastic layer 130 is reduced. It can be understood that during assembly, the lower surface of the first elastic layer 130 is at least partially supported by the assembly tool or the ground. As the first protrusion 120 moves, the first protrusion 120 gradually squeezes the first elastic layer 130 downward to compress the first elastic layer 130, so that the thickness M of the portion of the first elastic layer 130 below the first protrusion 120 is reduced. The height of the first protrusion 120 is reduced, so that the second protrusion 221 is more smoothly received in the second groove 150.

Please refer to FIG. 3 again, when the second protrusion 221 is located in the second groove 150, the first protrusion 120 is in the first position. That is to say, when the second protrusion 221 is located in the second groove 150, the downward pressure applied by the second protrusion 221 on the first protrusion 120 is reduced to the minimum or even disappears, so that the first elastic layer 130 recovers its shape under the action of its own elastic restoring force, and then the first protrusion 120 return to the first position. At this time, the height of the first protrusion 120 increases, which improves the limiting effect on the second protrusion 221, so that the connection strength of the first component 100 and the second component 200 in the lateral direction is enhanced, and the connection stability of the two is improved.

Please refer to FIG. 2 again, in some embodiments, the first elastic layer 130 is also disposed below the first plate 110. The first bottom wall 112 of the first plate 110 and the second bottom wall 122 of the first protrusion 120 are both connected to the first upper surface 131 of the first elastic layer 130. In other words, the first elastic layer 130 is disposed below the first plate 110. When the first plate 110 is stepped on, the first elastic layer 130 is compressed, which can provide an elastic buffering effect, improve the foot comfort, and enhance the user experience. The first bottom wall 112 and the second bottom wall 122 can be connected to the first upper surface 131 of the first elastic layer 130 by gluing.

Figure 9:
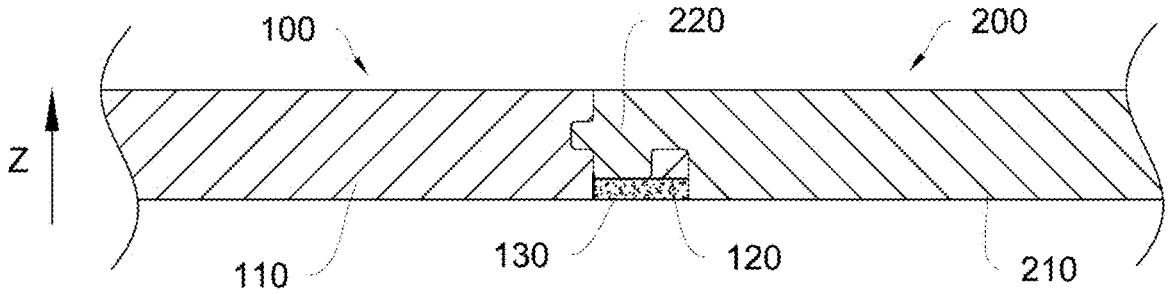
FIG. 9 is a part of a cross-sectional view of a flooring component according to another embodiment of the present application.
Figure 10:
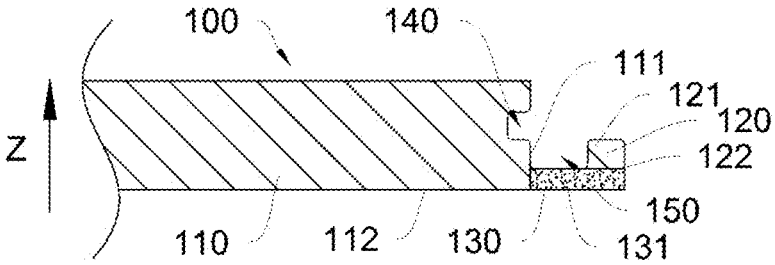
FIG. 10 is a part of FIG. 9.

In some embodiments, the first side wall 111 of the first plate 110 faces the second component 200, the opening 141 of the first groove 140 is defined on the first side wall 111, and the first protrusion 120 has a second side wall 121 opposite to the first side wall 111. Please refer to FIGS. 9 and 10, the first elastic layer 130 is connected to the first side wall 111 and extends toward the second component 200. The second bottom wall 122 of the first protrusion 120 is connected to the first upper surface 131 of the first elastic layer 130. The second groove 150 is defined by the first upper surface 131, the first side wall 111, and the second side wall 121 so that the second groove 150 is surrounded by the first upper surface 131, the first side wall 111, and the second side wall 121. In this embodiment, the first elastic layer 130 is arranged on the side of the first plate 110 facing the second component 200, and can also define the second groove 150 together with the first plate 110 and the first protrusion 120, so that the second groove 150 has the opening 151 facing upward and is surrounded by the first elastic layer 130, the first plate 110 and the first protrusion 120. In the process of the second protrusion 221 being inserted into the second groove 150, the second protrusion 221 squeezes the first protrusion 120, and the first protrusion 120 squeezes the first elastic layer 130, so that the first elastic layer 130 has an elastic deformation and is compressed, so that the first protrusion 120 can move outward in response to the deformation of the first elastic layer 130, and the opening 151 of the second groove 150 is enlarged. As the first protrusion 120 moves outward, the second protrusion 221 is gradually received into the second groove 150, and the third protrusion 222 is also gradually received into the first groove 140, and the downward pressure from the second protrusion 221 on the first protrusion 120 is reduced to disappear. The first elastic layer 130 is restored to its initial shape, and the first protrusion 120 returns to its initial position, so that the connection and locking of the first component 100 and the second component 200 are achieved.

Figure 11:
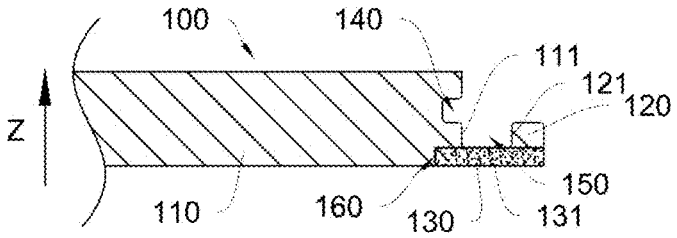
FIG. 11 is a part of a cross-sectional view of a first component in a flooring component according to another embodiment of the present application.
Figure 12:
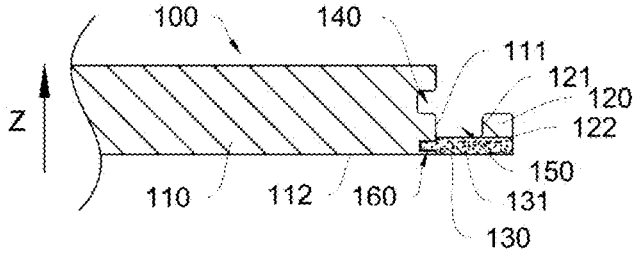
FIG. 12 is a part of a cross-sectional view of a first component in a flooring component according to another embodiment of the present application.

Please refer to FIGS. 11 and 12, in some embodiments, a mounting groove 160 is defined on a surface of the first plate 110 facing toward the second component 200. The mounting groove 160 is arranged below the first groove 140. The first elastic layer 130 is received in the mounting groove 160, and extends toward the second component 200 and is located below the first protrusion 120. Optionally, as shown in FIG. 11, the mounting groove 160 may be formed on the lower edge of the first plate 110 closer to the second component 200. The first elastic layer 130 is received in the mounting groove 160, so that the first upper surface 131 and one end surface of the first elastic layer 130 are connected to the first plate 110, thereby ensuring the connection strength between the two. As shown in FIG. 12, in some embodiments, the mounting groove 160 is formed at one end of the first plate 110 closer to the second component 200, and the mounting groove 160 is opened on the first side wall 111. By placing one end of the first elastic layer 130 in the mounting groove 160, the connection strength with the first plate 110 can be further strengthened. Optionally, the mounting groove 160 may be structured as a dovetail groove.

Optionally, in the embodiments shown in FIGS. 11 and 12, the connection between the first elastic layer 130 and the first plate 110 may be achieved by a hinge joint so that the first elastic layer 130 and the first plate 110 are rotatably connected with each other. When the first plate 110 is lifted up, the first elastic layer 130 rotates downward due to gravity, so that the angle of the opening 151 of the second groove 150 increases, and the second protrusion 221 is smoothly received in the second groove 150. After the first component 100 is placed on the ground, the first elastic layer 130 moves to its initial position due to the support of the ground, and the connection and locking of the first component 100 and the second component 200 are achieved.

Please refer to FIGS. 1 to 3 again, in some embodiments, in the thickness direction Z of the first component 100, the first groove 140 is located above the second groove 150. In the process of connecting the second component 200 with the first component 100, after the third protrusion 222 is inserted into the first groove 140, the third protrusion 222 can be used as a fulcrum. By rotating the second component 200 around the third protrusion 222, the second protrusion 221 can be more smoothly received in the second groove 150, and the third protrusion 222 can be more smoothly received in the first groove 140.

Please refer to FIG. 5, in some embodiments, the second component 200 further includes a second plate 210. The edge structure 220 is connected to a side of the second plate 210 closer to the first component 100. A third groove 240 is formed between the second plate 210 and the second protrusion 221. When the second protrusion 221 is received in the second groove 150, the first protrusion 120 is received in the third groove 240. In other words, the third groove 240 is an avoidance groove provided between the second plate 210 and the second protrusion 221. When the second component 200 and the first component 100 are connected, the first protrusion 120 is located between the second protrusion 221 and the second plate 210. By providing the third groove 240, the first protrusion 120 can be avoided, so that there is enough space to accommodate the first protrusion 120, and the first protrusion 120 can be made higher. Furthermore, by providing the third groove 240, the first component 100 and the second component 200 can be smoother after assembly, thereby improving the user experience.

Specifically, as shown in FIG. 5, the third protrusion 222 has a third side wall 223. The second plate 210 has a fourth side wall 211 opposite to the third side wall 223. The edge structure 220 further includes a connecting surface 224 connected between the third side wall 223 and the fourth side wall 211. The connecting surface 224, the third side wall 223, and the fourth side wall 211 form a third groove 240 so that the third groove 240 is surrounded by the connecting surface 224, the third side wall 223, and the fourth side wall 211.

Please further refer to FIG. 1, it can be understood that, in the above embodiments, the first groove 140, the second groove 150, and the third groove 240 are all through grooves extending along the length or width direction of the flooring component.

Please refer to FIGS. 3, 5 and 6, when the second protrusion 221 is received in the second groove 150, the third side wall 223 is in contact with the second side wall 121 of the first protrusion 120, and an angle $\alpha$ is formed between the third side wall 223 and the first upper surface 131 of the first elastic layer 130, which satisfies: $90° \leq \alpha \leq 100°$. By controlling the angle $\alpha$ within the above angle range, the interlocking effect between the third side wall 223 and the second side wall 121 can be improved, and the connection strength between the first component 100 and the second component 200 in the lateral direction can be further improved. Within the above range, when the angle $\alpha$ approaches 90°, the connection strength in the lateral direction is greater, and the right-angle surface is easier to process and the processing difficulty is lower; when the angle $\alpha$ approaches 100°, the second protrusion 221 is easier to be received into the second groove 150, and it is relatively easier to be assembled. Optionally, the angle $\alpha$ may be any angle value among 90°, 91°, 92°, 93°, 94°, 95°, 96°, 97°, 98°, 99°, 100°, or a value in a range between any two angle values above.

Please refer to FIGS. 1, 2 and 5 again, in some embodiments, the second component 200 further includes a second elastic layer 230. The second elastic layer 230 is arranged below the second plate 210 and is connected with the second plate 210. By providing the second elastic layer 230, when the second plate 210 is stepped on, the second elastic layer 230 is compressed, which can provide an elastic buffering effect, improve the foot comfort, and enhance the user experience.

Specifically, the third bottom wall 212 of the second plate 210 is connected to the second upper surface 231 of the second elastic layer 230. Optionally, the third bottom wall 212 may be connected to the second upper surface 231 by gluing.

Optionally, the materials of the first elastic layer 130 and the second elastic layer 230 are selected from one or more of rubber, thermoplastic elastomer (TPE), polyvinyl chloride (PVC) elastomer, polyethylene copolymer, and thermoplastic polyurethane (TPU). Specifically, the rubber may be natural rubber, nitrile rubber (NBR), chloroprene rubber (Neoprene), etc. Thermoplastic elastomer (TPE) has combined characteristics of both plastic and rubber and has good elasticity and processing performance. Polyvinyl chloride (PVC) elastomer has good chemical resistance and elasticity. Polyethylene copolymer, for example ethylene-vinyl acetate (EVA), has good elasticity and impact resistance. Thermoplastic polyurethane (TPU) has excellent elasticity, wear resistance and oil resistance.

Figure 13:
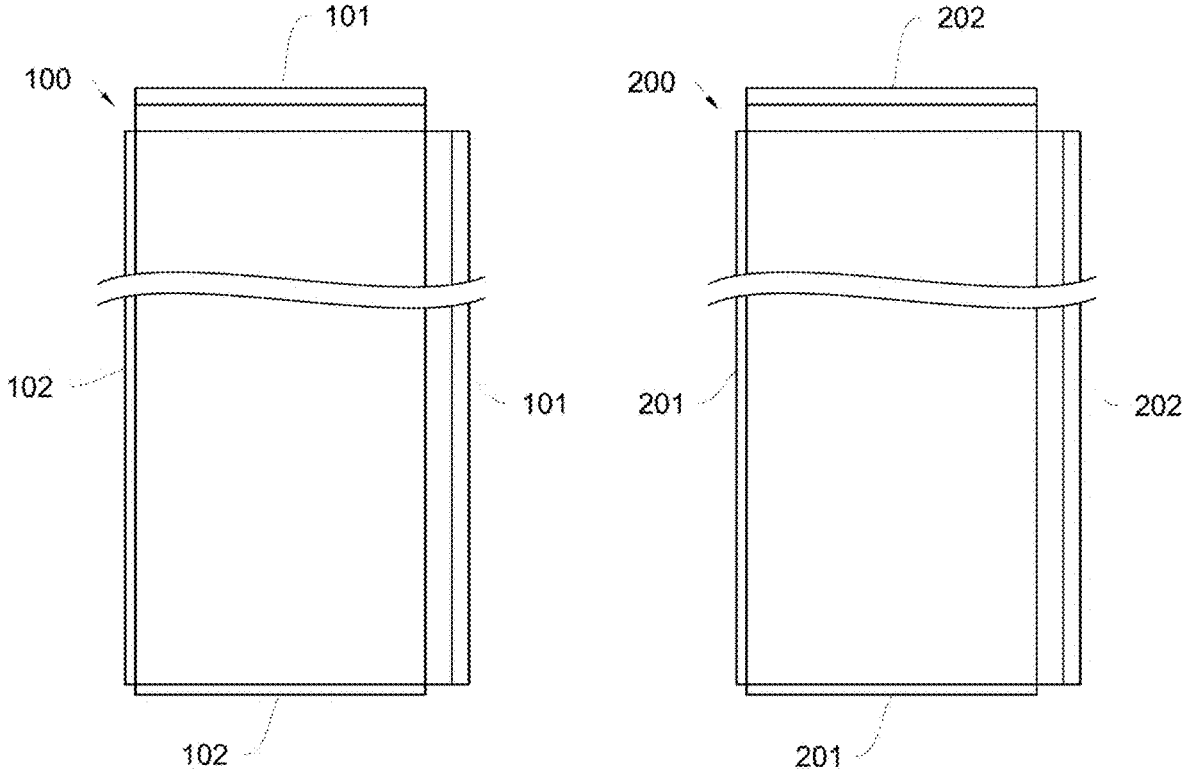
FIG. 13 is a schematic diagram of a top view of a flooring component in an unassembled state according to some embodiments of the present application.

Please refer to FIG. 13, optionally, in the flooring component, the first component 100 and the second component 200 are generally rectangular, and any two opposite sides of the four sides of the first component 100 are respectively the first side 101 and the second side 102, and any two opposite sides of the four sides of the second component 200 are respectively the third side 201 and the fourth side 202. In order to meet the use requirements of large-area paving, the four sides of the first component 100 and the four sides of the second component 200 are provided with the above-mentioned structure for interconnection.

Figure 14:
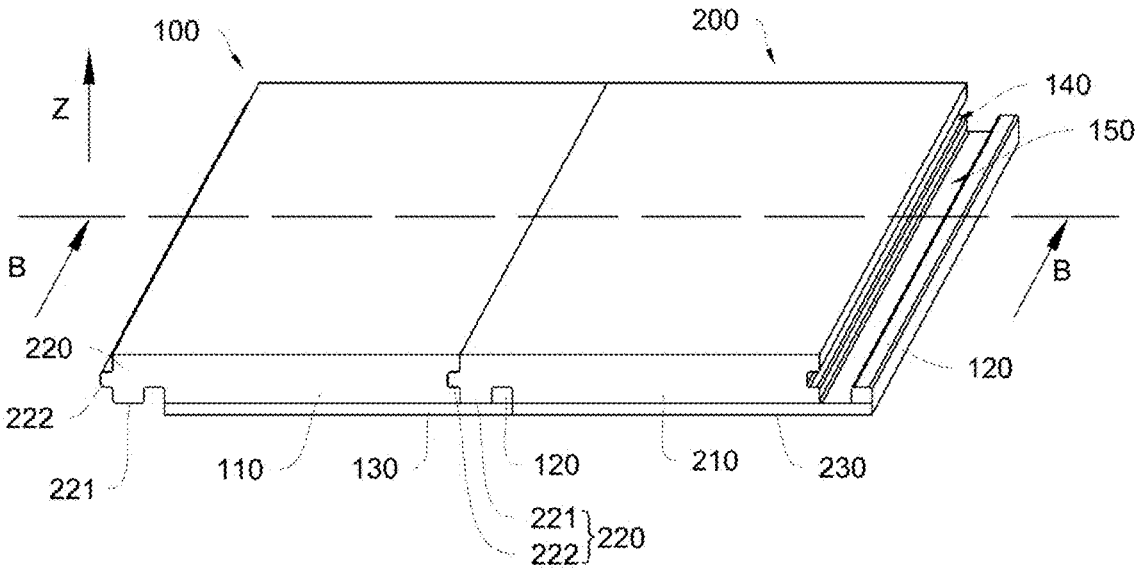
FIG. 14 is a schematic structural diagram of a flooring component according to another embodiment of the present application.
Figure 15:
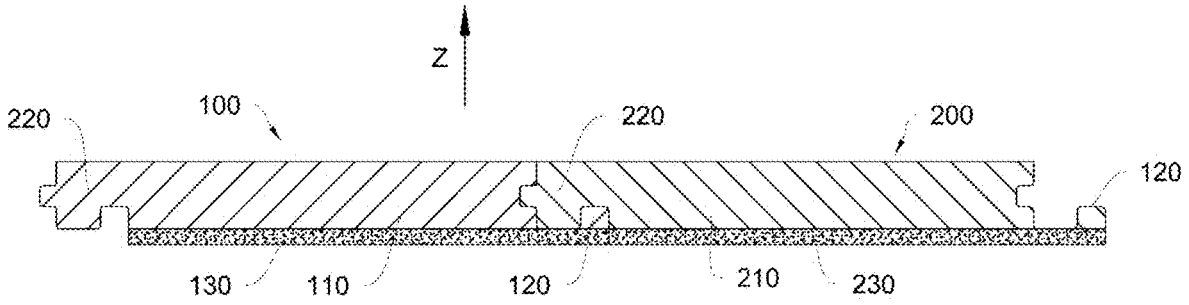
FIG. 15 is a cross-sectional view of the flooring component along line B-B in FIG. 14.
Figure 16:
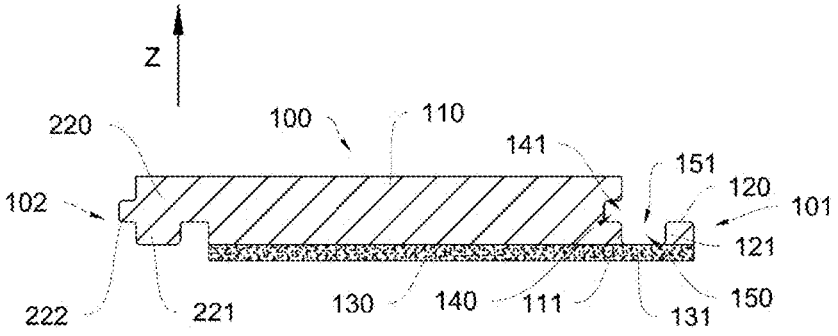
FIG. 16 is a cross-sectional view of a first component of the flooring component according to the embodiment shown in FIG. 14.
Figure 17:
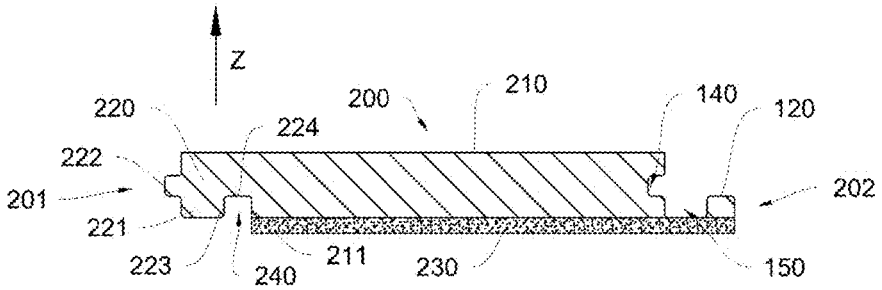
FIG. 17 is a cross-sectional view of a second component of the flooring component according to the embodiment shown in FIG. 14.

Please refer to FIGS. 14, 15, 16 and 17, in some embodiments, the first component 100 and the second component 200 are same in structure, and are both provided with an edge structure 220 and a first protrusion 120, and the edge structure 220 and the first protrusion 120 are arranged opposite to each other. As shown in FIGS. 13 and 14, both second sides 102 of the first component 100 are provided with edge structures 220, and the opposite first sides 101 are provided with mounting structures, such as the first protrusion 120, to match the edge structures 220. Such a configuration can meet the needs of paving a large surface area.

Figure 18:
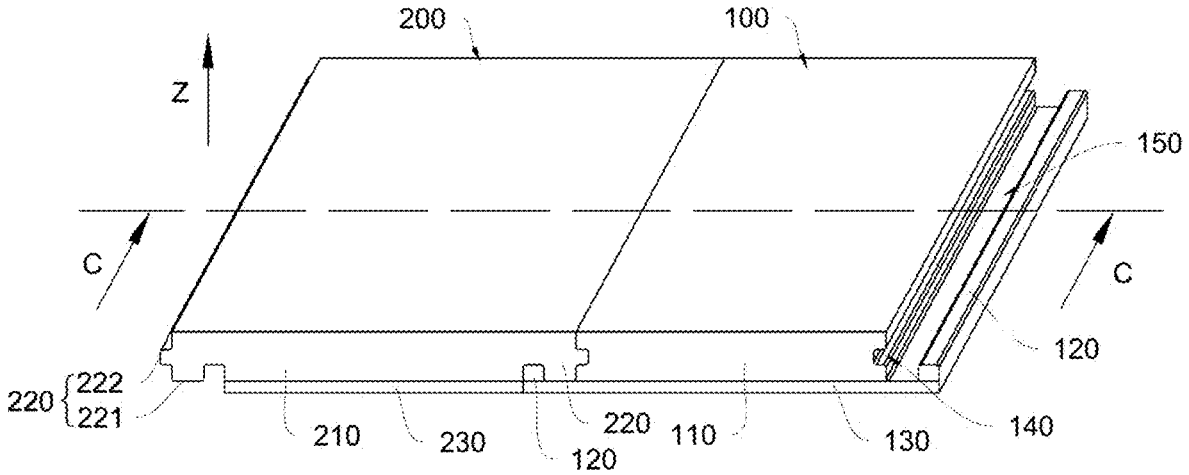
FIG. 18 is a schematic structural diagram of a flooring component according to another embodiment of the present application.
Figure 19:
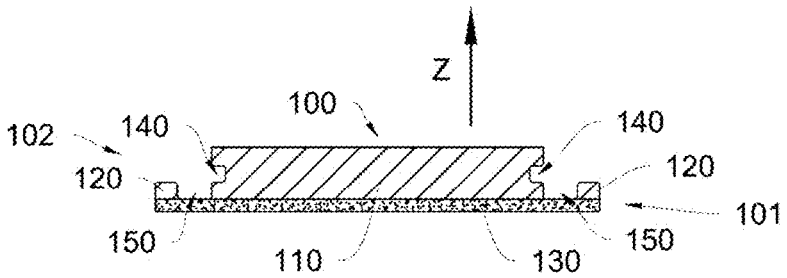
FIG. 19 is a cross-sectional view of a first component of the flooring component along line C-C in FIG. 18.
Figure 20:
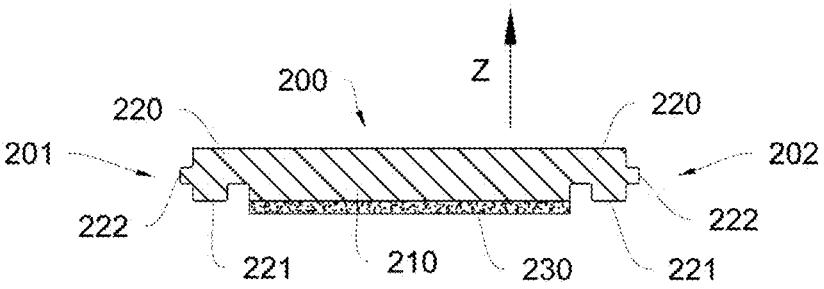
FIG. 20 is a cross-sectional view of a second component of the flooring component along line C-C in FIG. 18.

Please refer to FIGS. 18, 19 and 20, the first component 100 has a first side 101 and a second side 102 opposite to each other, and the first side 101 and the second side 102 are both provided with a first protrusion 120. The second component 200 has a third side 201 and a fourth side 202 opposite to each other, and the third side 201 and the fourth side 202 are both provided with an edge structure 220. In this way, the first component 100 and the second component 200 are alternately arranged to cover the surface.

Accordingly, an embodiment of the present application also provides a flooring, which may include the flooring components of any of the above embodiments, and thus may have all the technical features and technical effects of the above flooring components, which will not be repeated here. It should be noted that the flooring may be a solid wood flooring, a composite flooring, a solid wood composite flooring, a laminate flooring, and a flooring made of PVC (polyvinyl chloride) or other materials. The flooring may include a plurality of the above flooring components, and the specific number may depend on the actual ground area to be laid and the area that a single flooring component can cover. The area of a single flooring component may be the area of the structure obtained by assembling a first component 100 and a second component 200.

In the above embodiments, the description of each embodiment has its own emphasis. For parts that are not described in detail in a certain embodiment, reference can be made to the relevant descriptions of other embodiments.

The flooring components and floorings provided in the embodiments of the present application are introduced in detail above, and the principles and implementations of the present application are explained by using specific examples. The description of the above embodiments is only used to help understand the technical solutions and core ideas of the present application. Those skilled in the art should understand that they can still modify the technical solutions recorded in the aforementioned embodiments, or replace some of the technical features therein with equivalents; and these modifications or replacements do not make the essence of the corresponding technical solutions deviate from the scope of the technical solutions of the embodiments of the present application.

What is claimed is:

1. A flooring component, consisting of:

a first component and a second component, wherein the second component is configured to be connectable to at least one side of the first component;

wherein the first component comprises a first plate, a first protrusion and a first elastic layer, wherein a first groove facing toward the second component is defined on the first plate, the first protrusion is located on the first elastic layer adjacent a side of the first plate proximate to the second component and is spaced apart and separate from the first plate, the first elastic layer is arranged below the first protrusion and is connected to the first plate and the first protrusion, and the first plate, the first protrusion and the first elastic layer define a second groove with an opening facing upward so that the second groove is surrounded by the first plate, the first elastic layer and the first protrusion; and wherein the second component is provided with an edge structure comprising a second protrusion protruding downward and a third protrusion protruding toward the first component, wherein the second protrusion is configured to squeeze the first protrusion so that the first protrusion forces the first elastic layer to produce elastic deformation that enables the second protrusion to be received in the second groove and contact the first elastic layer and thereby enable the third protrusion to be received in the first groove.

2. A flooring component, comprising:

a first component and a second component, wherein the second component is configured to be connectable to at least one side of the first component;

wherein the first component comprises a first plate, a first protrusion and a first elastic layer, wherein a first groove facing toward the second component is defined on the first plate, the first protrusion is located on the first elastic layer adjacent a side of the first plate proximate to the second component and is spaced apart and separate from the first plate, the first elastic layer is arranged below the first protrusion and is connected to the first plate and the first protrusion, and the first plate, the first protrusion and the first elastic layer define a second groove with an opening facing upward so that the second groove is surrounded by the first plate, the first elastic layer and the first protrusion;

wherein the second component is provided with an edge structure comprising a second protrusion protruding downward and a third protrusion protruding toward the first component, wherein the second protrusion is configured to squeeze the first protrusion so that the first protrusion forces the first elastic layer to produce elastic deformation that enables the second protrusion to be received in the second groove and contact the first elastic layer and thereby enable the third protrusion to be received in the first groove;

wherein the first plate has a first side wall facing toward the second component, an opening of the first groove extends from the first side wall, and the first protrusion has a second side wall opposite to the first side wall; and wherein the first elastic layer is connected to the first side wall and a first bottom wall of the first plate, a second bottom wall of the first protrusion is connected to a first upper surface of the first elastic layer, and the second groove is surrounded by the first upper surface, the first side wall, and the second side wall.

3. The flooring component according to claim 2, wherein the first elastic layer is further arranged below the first plate, and the first bottom wall of the first plate and the second bottom wall of the first protrusion are both connected to the first upper surface of the first elastic layer.

4. The flooring component according to claim 2, wherein the first plate further has a mounting groove facing toward the second component, the mounting groove is arranged below the first groove, the first elastic layer is received in the mounting groove and extends toward the second component so that at least a portion of the first elastic layer is located below the first protrusion.

5. The flooring component according to claim 2, wherein the first component and the second component are same in structure, and the edge structure and the first protrusion are provided on each of the first component and the second component, wherein the edge structure and the first protrusion of each of the first component and the second component are arranged opposite to each other.

6. The flooring component according to claim 2, wherein the first component has a first side and a second side opposite to each other, and the first protrusion is arranged on each of the first side and the second side; wherein the second component has a third side and a fourth side opposite to each other, and the edge structure is arranged on each of the third side and the fourth side.

7. The flooring component according to claim 2, wherein the first protrusion is movable between a first position and a second position, wherein the opening of the second groove has a first size when the first protrusion is in the first position, and the opening of the second groove has a second size when the first protrusion is in the second position, and wherein the first size is smaller than the second size;

when the second protrusion presses the first protrusion, the first protrusion moves from the first position to the second position to enable the second protrusion to be received in the second groove.

8. The flooring component according to claim 7, wherein when the first protrusion moves from the first position to the second position, the first protrusion presses the first elastic layer to cause a compression deformation thereof, so that a thickness of at least a portion of the first elastic layer is reduced.

9. The flooring component according to claim 7, wherein when the first protrusion moves from the first position to the second position, the first protrusion presses the first elastic layer to cause a bending deformation thereof, so that at least a portion of the first elastic layer is bent downward.

10. The flooring component according to claim 7, wherein when the second protrusion is received in the second groove, the first protrusion is in the first position.

11. The flooring component according to claim 2, wherein the second component further comprises:

a second plate, wherein the edge structure is connected to a side of the second plate close to the first component, and a third groove is formed between the second plate and the second protrusion;

when the second protrusion is received in the second groove, the first protrusion is received in the third groove.

12. The flooring component according to claim 11, wherein the third protrusion has a third side wall, the second plate has a fourth side wall opposite to the third side wall, the edge structure further comprises a connecting surface connecting the third side wall to the fourth side wall, and the third groove is surrounded by the connecting surface, the third side wall and the fourth side wall.

13. The flooring component according to claim 12, wherein when the second protrusion is received in the second groove, the third side wall is in contact with a second side wall of the first protrusion, and an angle $\alpha$ is formed between the third side wall and a first upper surface of the first elastic layer, where $90° \leq \alpha \leq 100°$.

14. The flooring component according to claim 11, wherein the second component further comprises:

a second elastic layer, arranged below the second plate and is connected to the second plate.

15. The flooring component according to claim 14, wherein materials of the first elastic layer and the second elastic layer are selected from one or more of rubber, thermoplastic elastomer, polyvinyl chloride elastomer, polyethylene copolymer, and thermoplastic polyurethane.

16. A flooring system, comprising:

a plurality of the flooring components according to claim 2 configured to be connected together.

17. The flooring system according to claim 16, wherein the first protrusion is movable between a first position and a second position, wherein an opening of the second groove has a first size when the first protrusion is in the first position, and the opening of the second groove has a second size when the first protrusion is in the second position, and wherein the first size is smaller than the second size;

when the second protrusion presses the first protrusion, the first protrusion moves from the first position to the second position to enable the second protrusion to be received in the second groove.

18. The flooring system according to claim 17, wherein when the first protrusion moves from the first position to the second position, the first protrusion presses the first elastic layer to cause a compression deformation thereof, so that a thickness of at least a portion of the first elastic layer is reduced.

19. The flooring system according to claim 17, wherein when the first protrusion moves from the first position to the second position, the first protrusion presses the first elastic layer to cause a bending deformation thereof, so that at least a portion of the first elastic layer is bent downward.

20. The flooring system according to claim 17, wherein when the second protrusion is received in the second groove, the first protrusion is in the first position.

* * * * *